US011930907B1

(12) United States Patent
Yang

(10) Patent No.: US 11,930,907 B1
(45) Date of Patent: Mar. 19, 2024

(54) SIDE-PUSHED MAKEUP PEN

(71) Applicant: SHYA HSIN PACKAGING INDUSTRY (CHINA) CO., LTD., Kunshan (CN)

(72) Inventor: Haiying Yang, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 0 days.

(21) Appl. No.: 17/969,698

(22) Filed: Oct. 20, 2022

(30) Foreign Application Priority Data

Aug. 26, 2022 (CN) ..... 202211033646.0

(51) Int. Cl.
*A45D 34/04* (2006.01)
*A46B 11/00* (2006.01)

(52) U.S. Cl.
CPC ..... *A45D 34/04* (2013.01); *A46B 11/002* (2013.01); *A46B 11/0055* (2013.01); *A46B 11/0065* (2013.01)

(58) Field of Classification Search
CPC .... A45D 34/04; A45D 34/042; A45D 40/262; A45D 40/26; A45D 40/20; A46B 11/00; A46B 11/001; A46B 11/002; A46B 11/0055; A46B 11/0065
USPC ..... 401/188 R, 270, 272, 278
See application file for complete search history.

(56) References Cited

U.S. PATENT DOCUMENTS 5,851,080 A * 12/1998 Nakajima ..... A46B 11/0079 401/86
6,056,470 A 5/2000 Nehashi et al.
6,200,055 B1 3/2001 Fusaro, Jr.
8,308,386 B2 * 11/2012 Ki ..... A45D 34/042 401/187
9,770,736 B2 * 9/2017 Brugger ..... B05B 11/1015
2013/0108350 A1 * 5/2013 Ulrich ..... A45D 33/02 222/135

FOREIGN PATENT DOCUMENTS

CN 102131421 A 7/2011
CN 102176843 A 9/2011
JP 2010155347 A 7/2010

* cited by examiner

*Primary Examiner* — David J Walczak
(74) *Attorney, Agent, or Firm* — Bayramoglu Law Offices LLC

(57) ABSTRACT

A side-pushed makeup pen includes an applicator assembly, a pen body, a slider, a discharge assembly, and a container assembly. The pen body includes a first end connected to the applicator assembly and a second end detachably connected to the container assembly. The discharge assembly is slidably provided in the pen body. The slider is slidably provided on a sidewall of the pen body, and the slider is connected to the discharge assembly. The slider is configured to drive the discharge assembly to slide in an axial direction of the pen body. An elastic member is sleeved on the discharge assembly. A first valve is arranged between the pen body and the applicator assembly, and a second valve is arranged between the discharge assembly and the container assembly. Replenishing material to the applicator assembly is operable with a single hand of the user.

17 Claims, 5 Drawing Sheets

SIDE-PUSHED MAKEUP PEN

CROSS REFERENCE TO THE RELATED APPLICATIONS

This application is based upon and claims priority to Chinese Patent Application No. 202211033646.0, filed on Aug. 26, 2022, the entire contents of which are incorporated herein by reference.

TECHNICAL FIELD

The present application relates to the field of cosmetics and in particular to a side-pushed makeup pen.

BACKGROUND

With the improvement of people's living standards, cosmetics have been applied increasingly and developed toward more varieties and for more purposes. For most existing makeup pens, the cosmetic liquid in a nib needs to be replenished by rotating a rotary portion during use. However, the makeup pens are operated with two hands, which causes great inconvenience.

SUMMARY

In view of the above defects, the present application provides a side-pushed makeup pen. Since a slider of the makeup pen is provided on a sidewall of a pen body, the user can push the slider with a single hand to replenish cosmetic material to an applicator assembly when applying makeup, making the pen convenient to use.

To solve the technical problem, the present application adopts the following technical solutions:

A side-pushed makeup pen includes an applicator assembly, a pen body, a slider, a discharge assembly, and a container assembly. The pen body includes a first end connected to the applicator assembly and a second end detachably connected to the container assembly. The discharge assembly is slidably provided in the pen body. The slider is slidably provided on a sidewall of the pen body, and the slider is connected to the discharge assembly. The slider is configured to drive the discharge assembly to slide in an axial direction of the pen body. An elastic member is sleeved on the discharge assembly. A first valve is arranged between the pen body and the applicator assembly. A second valve is arranged between the discharge assembly and the container assembly.

Optionally, the discharge assembly includes a coupling rod and a transmission shaft that are connected axially and fixedly. The slider is connected axially and fixedly to the transmission shaft or the coupling rod.

Optionally, the elastic member is sleeved on the coupling rod, and the elastic member includes a first end abutting against the pen body and a second end abutting against the coupling rod. Or, the elastic member is sleeved on the transmission shaft, and the elastic member includes a first end abutting against the pen body and a second end abutting against the transmission shaft.

Optionally, the second valve is arranged between the container assembly and the transmission shaft, or the second valve is arranged between the container assembly and the coupling rod.

Optionally, a mounting groove is axially formed in the sidewall of the pen body. A first stopper and a second stopper are respectively provided on the pen body at two ends of the mounting groove. A sleeve is axially provided in the pen body. A first discharge port is formed in the sleeve. The first valve is provided at the first discharge port.

Optionally, the discharge assembly further includes a bottle shoulder. The bottle shoulder is fixedly provided in the second end of the pen body. The slider is provided in the mounting groove. The coupling rod is slidably inserted into the sleeve, and the transmission shaft is slidably inserted into the bottle shoulder. Or, the transmission shaft is slidably inserted into the sleeve, and the coupling rod is slidably inserted into the bottle shoulder.

Optionally, each of the first valve and the second valve is a one-way valve. An opening direction of the first valve refers to a direction from the discharge assembly to the applicator assembly. An opening direction of the second valve refers to a direction from the container assembly to the discharge assembly.

Optionally, the side-pushed makeup pen further includes an outer cover. The outer cover covers the applicator assembly. The applicator assembly includes an application head, a nib, and an application head seat. The application head is fixedly provided on the application head seat, and the application head communicates with a liquid passage in the application head seat. The nib is fixedly sleeved outside the application head and the application head seat.

Optionally, the container assembly includes a bottle, a piston, and a tail plug. The tail plug is firmly plugged at a tail end of the bottle. The piston is hermetically provided in the bottle on the inner side of the tail plug. An air vent communicating with the outside is formed in the tail plug.

Optionally, the side-pushed makeup pen further includes a replacement assembly. The replacement assembly includes the container assembly and a replacement cover. The replacement cover covers the container assembly.

The present application has the following beneficial effects:

1) The side-pushed makeup pen includes an applicator assembly, a pen body, a slider, a discharge assembly, and a container assembly. The discharge assembly includes a coupling rod, a transmission shaft, and a bottle shoulder. The slider is provided on the sidewall of the pen body. During makeup, the user pushes the slider axially along the pen body, such that material in the container assembly flows to the applicator assembly through the discharge assembly for use. Therefore, the user can operate the slider with a single hand to replenish material to the applicator assembly, and the use is very convenient.
2) The container assembly and the applicator assembly are connected by the discharge assembly. A discharge port between the applicator assembly and the discharge assembly is opened or closed under the control of the first valve. A discharge port between the container assembly and the discharge assembly is opened or closed under the control of a second valve. Therefore, the makeup pen has a desirable sealing function without material leakage. Since each of the first valve and the second valve is a one-way valve, the material or gas in the applicator assembly does not flow back to the discharge assembly, and the material or gas in the discharge assembly does not flow back to the container assembly, thereby ensuring the quality of the material and prolonging the service life of the material.
3) The container assembly is detachably connected to the discharge assembly, and a replacement assembly is provided. When the material in a bottle is used up, the old bottle can be replaced by a new one in the replacement assembly. Therefore, the applicator assembly and the press assembly are reusable to reduce the waste of resources.

Figure 1:
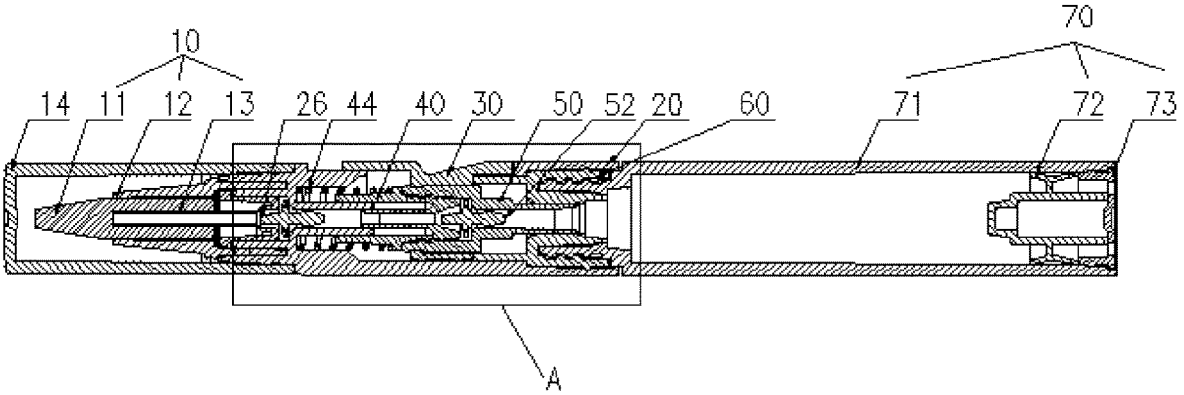
FIG. 1 is a schematic structural view before a makeup pen is pressed according to the present application.

In the figures: 10—applicator assembly, 11—application head, 12—nib, 13—application head seat, 14—outer cover, 20—pen body, 21—mounting groove, 22—sleeve, 23—first discharge port, 24—first stopper, 25—second stopper, 26—first valve, 30—slider, 31—sleeving portion, 32—protrusion, 33—gap, 40—coupling rod, 41—discharge barrel, 42—convex rib, 43—retainer ring, 44—elastic member, 50—transmission shaft, 51—second discharge port, 52—second valve, 60—bottle shoulder, 70—container assembly, 71—bottle, 72—piston, 73—tail plug, 80—replacement assembly, and 81—replacement cover.

DETAILED DESCRIPTION OF THE EMBODIMENTS

The technical solutions in the embodiments of the present application are clearly and completely described below with reference to the embodiments of the present application. The described embodiments are merely some, rather than all of the embodiments of the present application. All other embodiments obtained by those of ordinary skill in the art based on the embodiments of the present application without creative efforts should fall within the protection scope of the present application.

It should be noted that the terms "first", "second", and so on in the description and claims of this application and the accompanying drawings are intended to distinguish similar objects but do not necessarily indicate a specific order or sequence. It should be understood that the data used in such a way may be exchanged under proper conditions to make it possible to implement the described implementations of this application in sequences except those illustrated or described herein. Moreover, the terms "include", "contain", and any other variants are meant to cover the non-exclusive inclusion, for example, a process, method, system, product, or device that includes a list of steps or units is not necessarily limited to those steps or units which are clearly listed but may include other steps or units which are not expressly listed or inherent to such a process, method, system, product, or device.

For ease of description, spatially relative terms, such as "above", "on the upper side of", "on the upper surface of" and "on", can be used to describe the spatial positional relationship between components or features shown in the figure. It should be understood that the spatially relative terms are intended to encompass different orientations of the components in use or operation in addition to those shown in the figure. For example, if a component in the figure is inverted, it can be described as a component "above other component or structure" or "on other component or structure" or positioned as "below other component or structure" or "under other component or structure". Therefore, the term "above" may include both orientations "above" and "below". The component may also be positioned in other different ways (e.g., rotated by 90 degrees or in other orientations), but the relative description of the space should be explained accordingly.

Embodiment: A side-pushed makeup pen includes applicator assembly 10, pen body 20, slider 30, discharge assembly, and container assembly 70. The pen body 20 includes a first end connected to the applicator assembly 10 and a second end detachably connected to the container assembly 70. The discharge assembly is slidably provided in the pen body 20. The slider 30 is slidably provided on a sidewall of the pen body 20, and the slider 30 is connected to the discharge assembly. The slider 30 is configured to drive the discharge assembly to slide in an axial direction of the pen body 20. Elastic member 44 is sleeved on the discharge assembly. First valve 26 is arranged between the pen body 20 and the applicator assembly 10. Second valve 52 is arranged between the discharge assembly and the container assembly 70. When the slider 30 is stressed to slide along the axial direction of the pen body 20, the discharge assembly slides synchronously and compresses the elastic member 44, such that a cavity in the discharge assembly becomes smaller with a material therein opening the first valve 26 and flowing to the applicator assembly 10 for makeup. When an external force on the slider 30 is removed, the elastic member 44 is extended to drive the discharge assembly for restoration, pressure in the cavity is reduced, and material in the container assembly 70 opens the second valve 52 to enter the cavity for later use.

Figure 2:
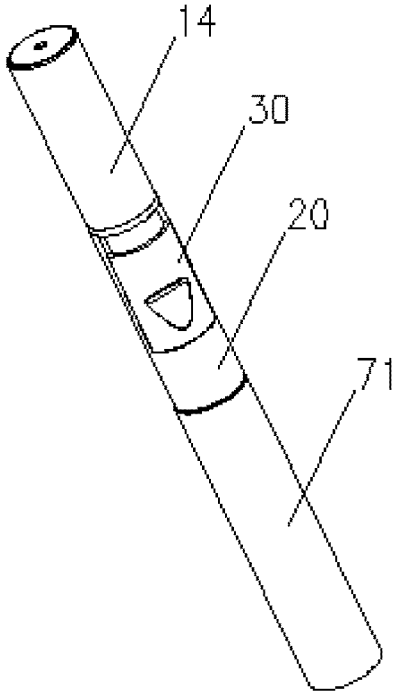
FIG. 2 is a perspective view before a makeup pen is pressed according to the present application.
Figure 3:
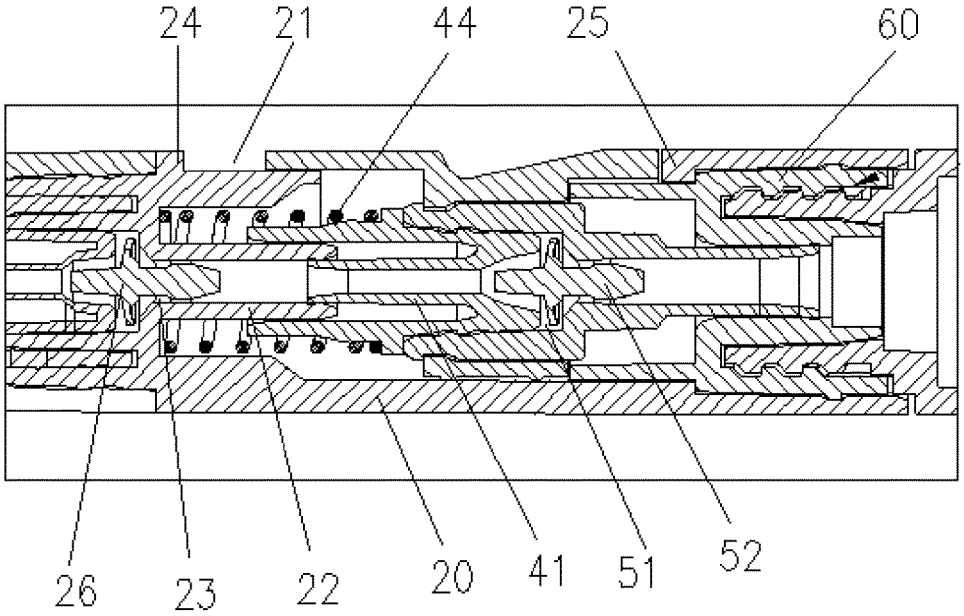
FIG. 3 is an enlarged view of Ain FIG. 1.
Figure 4:
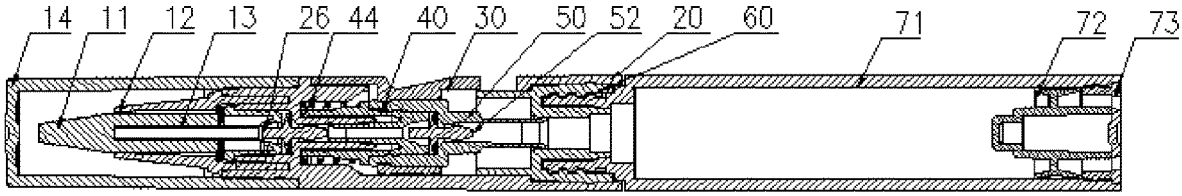
FIG. 4 is a schematic structural view after a makeup pen is pressed according to the present application.
Figure 5:
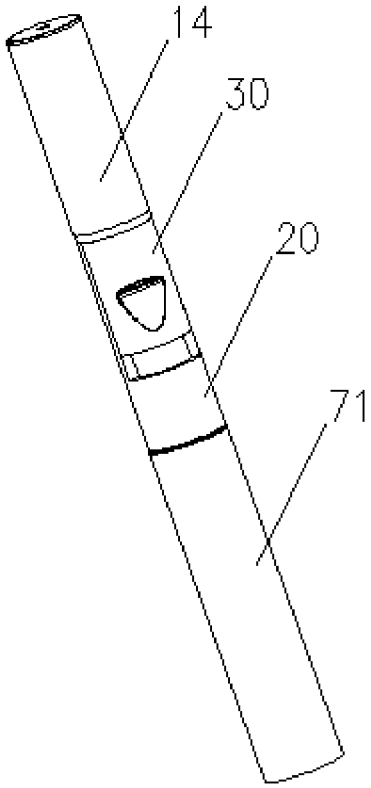
FIG. 5 is a perspective view after a makeup pen is pressed according to the present application.

As shown in FIGS. 1-10, the first end of the pen body 20 is fixedly connected to the applicator assembly 10. The container assembly 70 is detachably provided at the second end of the pen body 20. Optionally, the container assembly 70 is bolted or clamped at the second end of the pen body 20. The container assembly 70 is configured to store cosmetic material. The discharge assembly is configured to guide the material in the container assembly 70 to the applicator assembly 10. The applicator assembly 10 is configured for makeup, namely, the applicator assembly 10 is configured for applying the material to a necessary site of the user such as a face or a body surface. The discharge assembly is provided in the pen body 20. Optionally, the applicator assembly 10, the discharge assembly, the pen body 20, and the container assembly 70 are coaxial. The slider 30 is provided axially and slidably on the sidewall of the pen body 20. The discharge assembly is fixedly connected to the slider 30. As shown in FIG. 1 and FIG. 2, when the makeup pen is not used, the slider 30 is close to the container assembly 70. Both the first valve 26 and the second valve 52 are closed, namely, the discharge assembly does not communicate with the applicator assembly 10 and the container assembly 70. As shown in FIG. 4 and FIG. 5, when the makeup pen is used, the slider 30 is pushed toward the applicator assembly 10, the discharge assembly slides synchronously under the driving of the slider, and the material in the discharge assembly opens the first valve 26 and flows to the applicator assembly through a gap between the first valve 26 and the discharge assembly. When the slider 30 is loosened, the elastic member 44 is extended and restored to drive the discharge assembly for restoration. Since the pressure in the discharge assembly is less than that in the container assembly 70, the material in the container assembly 70 opens the second valve 52 to flow to the discharge assembly until the pressures at two sides of the second valve 52 are balanced, and the first valve 26 and the second valve 52 are closed again. In this case, the applicator assembly 10 is fully filled with the material for later use when the slider is pushed again. In the embodiment of the present application, since the slider is provided on the sidewall of the pen body, the makeup pen can replenish material to the applicator assembly through a one-handed operation of the user and is used conveniently.

Figure 8:
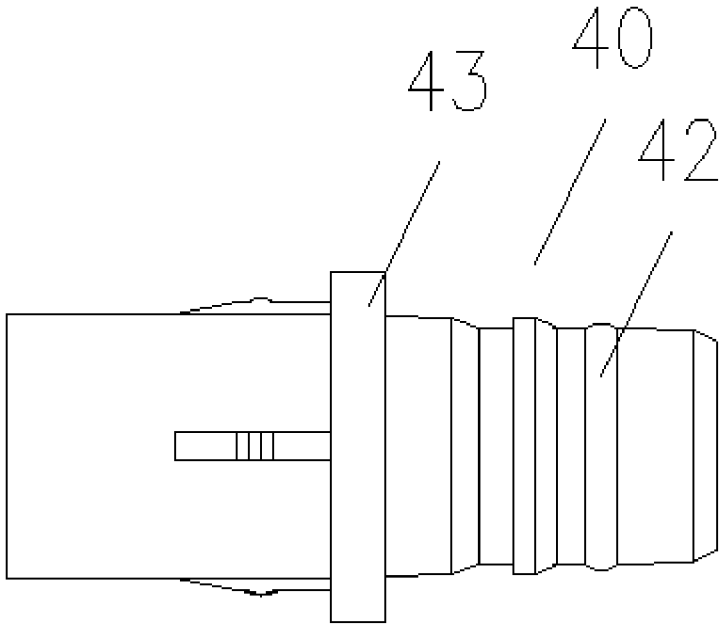
FIG. 8 is a schematic structural view of a coupling rod according to the present application.

As shown in FIG. 1 and FIG. 3, the discharge assembly includes coupling rod 40 and transmission shaft 50 that are connected axially and fixedly. The slider 30 is connected axially and fixedly to the transmission shaft 50 or the coupling rod 40. The transmission shaft 50 is sleeved on the coupling rod 40, and the slider 30 is sleeved on the transmission shaft 50. Optionally, the transmission shaft 50 is fixedly connected to the coupling rod 40, and the slider 30 is fixedly connected to the transmission shaft 50, namely the slider 30, the coupling rod 40 and the transmission shaft 50 are fixed together. Optionally, as shown in FIG. 3 and FIG. 8, discharge barrel 41 is axially arranged in the coupling rod 40. An outer surface of the coupling rod 40 extends outward along a radial direction to form convex rib 42 and retainer ring 43. Second discharge port 51 is formed in the transmission shaft 50. The discharge barrel 41 is slidably inserted into the pen body 20. The transmission shaft 50 includes a first end sleeved on the coupling rod 40 and clamped with the coupling rod 40 through the convex rib 42 on the coupling rod 40 and a second end slidably inserted into the container assembly 70. Certainly, the slider 30 may also be fixed on the coupling rod 40. In another implementation, the discharge barrel 41 is slidably inserted into the container assembly 70. The second end of the transmission shaft 50 is slidably inserted into the pen body 20.

The elastic member 44 is sleeved on the coupling rod 40, and the elastic member 44 includes a first end abutting against the pen body 20 and a second end abutting against the coupling rod 40. Or, the elastic member 44 is sleeved on the transmission shaft 50, and the elastic member 44 includes a first end abutting against the pen body 20 and a second end abutting against the transmission shaft 50. As shown in FIG. 3, the elastic member 44 is sleeved on the coupling rod 40, and the elastic member 44 includes the first end abutting against the pen body 20 and the second end abutting against the retainer ring 43 on the coupling rod. In another implementation, the elastic member 44 is sleeved on the transmission shaft 50, and the elastic member 44 includes the first end abutting against the pen body 20 and the second end abutting against the transmission shaft 50. The elastic member 44 is compressed and shortened overall along the axial direction when stressed. When the external force is removed, the elastic member 44 is extended and restored under the action of its elasticity.

The second valve 52 is arranged between the container assembly 70 and the transmission shaft 50. As shown in FIG. 3, the coupling rod 40 is provided at the left side of the transmission shaft 50, the transmission shaft 50 is connected to the container assembly 70, and the second valve 52 is arranged between the transmission shaft and the container assembly 70. Optionally, the second discharge port 51 is formed in the transmission shaft 50, and the second valve 52 is provided at the second discharge port 51, such that the material in the container assembly flows to the transmission shaft 50. Or the second valve 52 is arranged between the container assembly 70 and the coupling rod 40. The coupling rod 40 is provided at the right side of the transmission shaft 50, the coupling rod 40 is connected to the container assembly 70, and the second valve 52 is arranged between the coupling rod and the container assembly 70.

Figure 6:
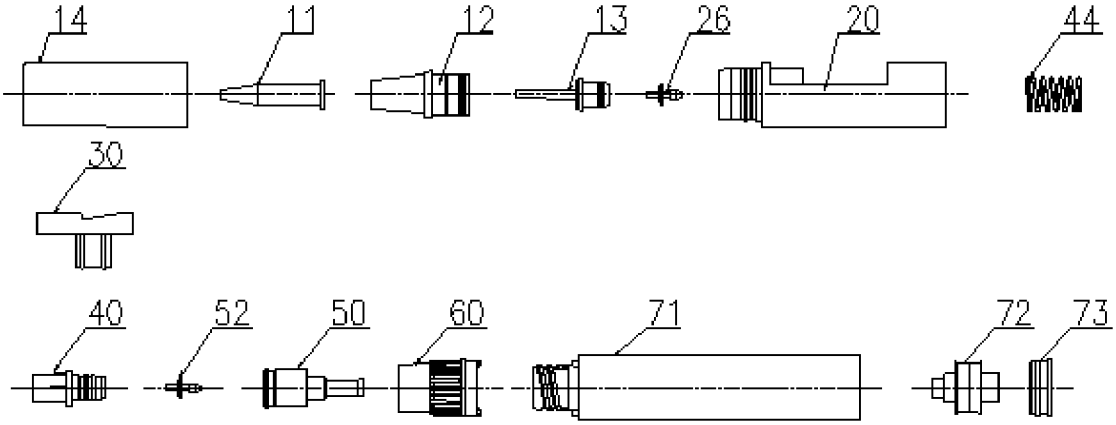
FIG. 6 is an exploded view of a makeup pen according to the present application.

As shown in FIG. 1, FIG. 3 and FIG. 6, mounting groove 21 is axially formed in the sidewall of the pen body 20. First stopper 24 and second stopper 25 are respectively provided on the pen body 20 at two ends of the mounting groove 21. Sleeve 22 is axially provided in the pen body 20. First discharge port 23 is formed in the sleeve 22. The first valve 26 is provided at the first discharge port 23. The first end of the pen body 20 is fixedly provided in the applicator assembly 10. The sleeve 22 is provided in the pen body 20 and near the first end. A discharge passage is formed in the sleeve 22. An end of the discharge passage close to the applicator assembly is provided with the first discharge port 23. The first valve 26 is provided at the first discharge port 23 to control the material discharging.

Figure 7:
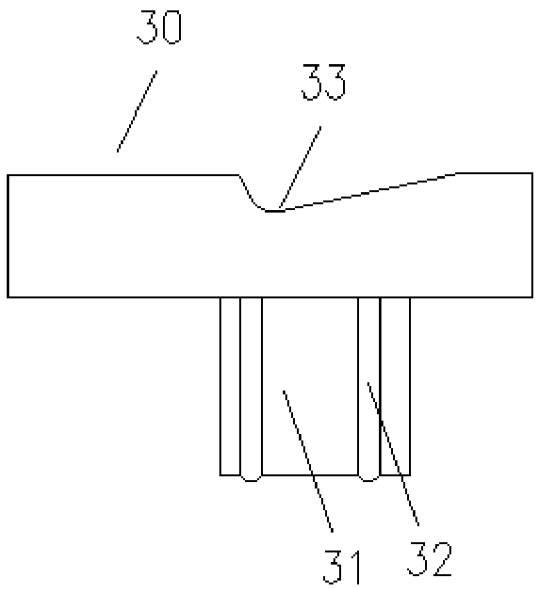
FIG. 7 is a schematic structural view of a slider according to the present application.

As shown in FIGS. 1-8, the discharge assembly further includes bottle shoulder 60. The bottle shoulder 60 is fixedly provided in the second end of the pen body 20. The slider 30 is provided in the mounting groove 21. The coupling rod 40 is slidably inserted into the sleeve 22. The transmission shaft 50 is slidably inserted into the bottle shoulder 60. The first discharge port 23 is formed in the pen body 20. The discharge barrel of the coupling rod 40 is inserted into the sleeve 22 of the pen body. The first valve 26 is provided at the first discharge port 23. The transmission shaft 50 is fixedly sleeved on the coupling rod 40. As shown in FIG. 7, gap 33 is formed in the sidewall of the slider 30. For ease of operation, the gap 33 has an oblique surface. Sleeving portion 31 is provided on the slider 30. The outer surface of the sleeving portion 31 extends outward along a radial direction to form protrusion 32. As shown in FIG. 3, the slider 30 is provided in the mounting groove 21, and the sleeving portion 31 is fixedly sleeved on the transmission shaft 50. Consequently, the slider 30 can slide back and forth in a chute between the first stopper 24 and the second stopper 25. The protrusion 32 of the slider 30 comes in contact with the inner sidewall of the pen body 20, thereby reducing the frictional force between the slider and the pen body. The transmission shaft 50 is slidably inserted into the bottle shoulder 60. The second discharge port 51 is formed in the transmission shaft 50. The second valve 52 is provided at the second discharge port 51. Or in another implementation, the transmission shaft 50 is slidably inserted into the sleeve 22. The coupling rod 40 is slidably inserted into the bottle shoulder 60.

Each of the first valve 26 and the second valve 52 is a one-way valve. The opening direction of the first valve 26 refers to the direction from the discharge assembly to the applicator assembly 10. The opening direction of the second valve 52 refers to the direction from the container assembly 70 to the discharge assembly. According to the present application, the container assembly and the applicator assembly are connected by the discharge assembly. A discharge port between the applicator assembly and the discharge assembly is opened or closed under the control of the first valve. A discharge port between the container assembly and the discharge assembly is opened or closed under the control of the second valve. Therefore, the makeup pen has a desirable sealing function without material leakage. Since each of the first valve and the second valve is a one-way valve, the material or gas in the applicator assembly does not flow back to the discharge assembly, and the material or gas in the discharge assembly does not flow back to the container assembly, thereby ensuring the quality of the material and prolonging the service life of the material.

As shown in FIG. 1, FIG. 3, and FIG. 4, the makeup pen further includes outer cover 14. The outer cover 14 covers the applicator assembly 10. The applicator assembly 10 includes application head 11, nib 12, and application head seat 13. The application head 11 is fixedly provided on the application head seat 13, and the application head 11 communicates with a liquid passage in the application head seat 13. The nib 12 is fixedly sleeved outside the application head 11 and the application head seat 13. The application head 11 is extended out of the nib 12. The application head seat 13 is inserted into the application head 11. The first end of the pen body 20 is fixedly provided between the nib 12 and the application head seat 13. The outer cover 14 covers the nib 12 to seal the application head 11. The material in the discharge assembly flows to the application head 11 through the liquid passage in the application head seat 13 for use.

As shown in FIG. 1, FIG. 3, and FIG. 4, the container assembly 70 includes bottle 71, piston 72, and tail plug 73. The tail plug 73 is firmly plugged at the tail end of the bottle 71. The piston 72 is hermetically provided in the bottle 71 on the inner side of the tail plug 73. An air vent communicating with the outside is formed in the tail plug 73. The bottle 71 includes a head bolted to the bottle shoulder 60 and a tail provided with the tail plug 73. The bottle 71 and the tail plug 73 may be of a split structure, and may also be of an integral structure. When the material in the bottle 71 is drawn into the discharge assembly, outside air enters the bottle through the air vent to keep pressures inside and outside the bottle balanced. By pushing the material with the piston, the material does not remain in the bottle, thereby improving the utilization rate of the material and reducing waste.

Figure 9:
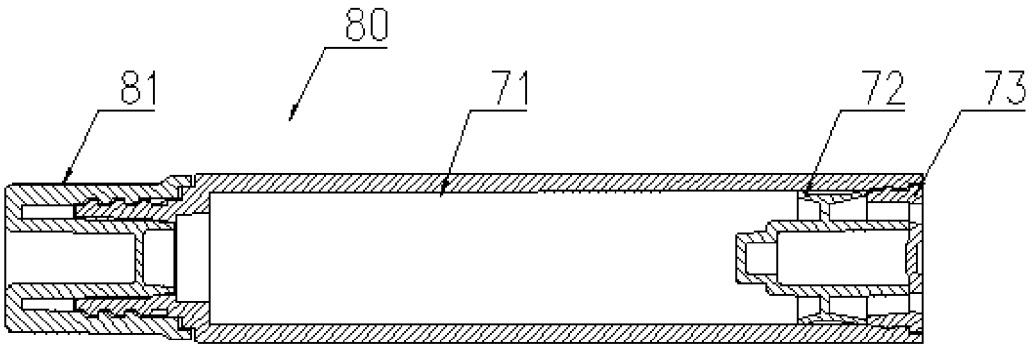
FIG. 9 is a schematic structural view of a replacement assembly according to the present application.
Figure 10:
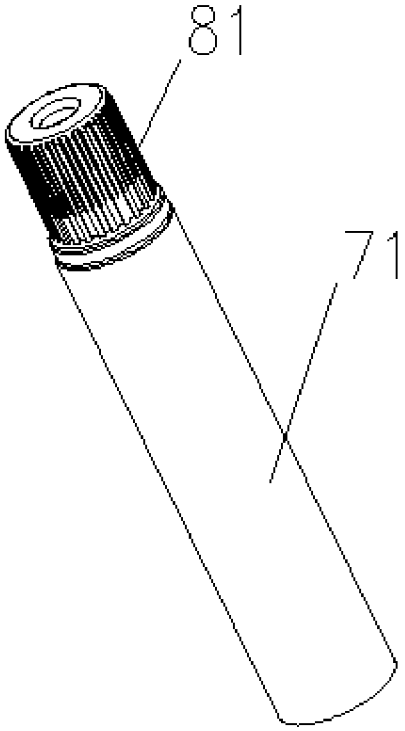
FIG. 10 is a perspective view of a replacement assembly according to the present application.

As shown in FIG. 9 and FIG. 10, the makeup pen further includes replacement assembly 80. The replacement assembly 80 includes the container assembly 70 and replacement cover 81. The replacement cover 81 covers the container assembly. Because of the replacement assembly 80 in the present application, when the material in the bottle 71 is used up, the replacement cover is screwed off, and the old bottle can be replaced by a new one in the replacement assembly. Therefore, the applicator assembly and the press assembly are reusable to reduce the waste of resources.

The side-pushed makeup pen in the embodiment of the present application has the following operation process:

Step 1: As shown in FIG. 1 and FIG. 2, when the side-pushed makeup pen is not used, the slider 30 is attached to the second stopper 25. Both the first valve 26 and the second valve 52 are closed, namely, the discharge assembly does not communicate with the applicator assembly 10 and the container assembly 70.

Step 2: As shown in FIG. 4 and FIG. 5, when the side-pushed makeup pen is used and the slider 30 is pushed up, the slider 30 is attached to the first stopper 24 and slidably drives the discharge assembly to slide synchronously. The material in the discharge assembly is squeezed out to flow to the first valve 26 and opens the first valve 26, and the material flows to the applicator assembly 10 through the first discharge port of the pen body 20.

Step 3: When the slider 30 is loosened, the slider 30 is restored under the action of the elastic member 44. Since the pressure in the discharge assembly is less than that in the container assembly 70, the material in the bottle 71 opens the second valve 52 to flow to the discharge assembly until the pressures in the discharge assembly and the container assembly 70 are balanced, and the first valve 26 and the second valve 52 are closed again. In this case, the applicator assembly 10 is fully filled with the material.

It should be noted that those of ordinary skill in the art can further make variations and improvements without departing from the concept of the present application. These variations and improvements all fall within the protection scope of the present application. Therefore, the protection scope of the present application should be subject to the protection scope defined by the claims.

What is claimed is:

1. A side-pushed makeup pen, comprising an applicator assembly, a pen body, a slider, a first valve, a second valve, a discharge assembly, and a container assembly, wherein the pen body comprises a first end connected to the applicator assembly and a second end detachably connected to the container assembly; the discharge assembly is slidably provided in the pen body; the slider is slidably provided on a sidewall of the pen body, and the slider is connected to the discharge assembly; the slider is configured to drive the discharge assembly to slide in an axial direction of the pen body; an elastic member is sleeved on the discharge assembly; the first valve is arranged between the discharge assembly and the applicator assembly; the second valve is arranged between the discharge assembly and the container assembly; and the slider, the discharge assembly and the first valve are configured such that sliding the slider toward the applicator assembly opens the first valve and initiates flow of cosmetic material from the discharge assembly through the first valve to the applicator assembly.

2. The side-pushed makeup pen according to claim 1, wherein the discharge assembly comprises a coupling rod and a transmission shaft, wherein the coupling rod and the transmission shaft are connected axially and fixedly; and the slider is connected axially and fixedly to the transmission shaft or the coupling rod.

3. The side-pushed makeup pen according to claim 2, wherein the container assembly comprises a bottle, a piston, and a tail plug, wherein the tail plug is firmly plugged at a tail end of the bottle; the piston is hermetically provided in the bottle on an inner side of the tail plug; and an air vent communicating with an outside is formed in the tail plug.

4. The side-pushed makeup pen according to claim 2, wherein the elastic member is sleeved on the coupling rod, and the elastic member comprises a first end abutting against the pen body and a second end abutting against the coupling rod; or the elastic member is sleeved on the transmission shaft, and the elastic member comprises a first end abutting against the pen body and a second end abutting against the transmission shaft.

5. The side-pushed makeup pen according to claim 4, wherein the container assembly comprises a bottle, a piston, and a tail plug, wherein the tail plug is firmly plugged at a tail end of the bottle; the piston is hermetically provided in the bottle on an inner side of the tail plug; and an air vent communicating with an outside is formed in the tail plug.

6. The side-pushed makeup pen according to claim 2, wherein the second valve is arranged between the container assembly and the transmission shaft, or the second valve is arranged between the container assembly and the coupling rod.

7. The side-pushed makeup pen according to claim 6, wherein the container assembly comprises a bottle, a piston, and a tail plug, wherein the tail plug is firmly plugged at a tail end of the bottle; the piston is hermetically provided in the bottle on an inner side of the tail plug; and an air vent communicating with an outside is formed in the tail plug.

8. The side-pushed makeup pen according to claim 2, wherein a mounting groove is axially formed in the sidewall of the pen body; a first stopper and a second stopper are respectively provided on the pen body at two ends of the mounting groove; a sleeve is axially provided in the pen body; a first discharge port is formed in the sleeve; and the first valve is provided at the first discharge port.

9. The side-pushed makeup pen according to claim 8, wherein the container assembly comprises a bottle, a piston, and a tail plug, wherein the tail plug is firmly plugged at a tail end of the bottle; the piston is hermetically provided in the bottle on an inner side of the tail plug; and an air vent communicating with an outside is formed in the tail plug.

10. The side-pushed makeup pen according to claim 8, wherein the discharge assembly further comprises a bottle shoulder; wherein the bottle shoulder is fixedly provided in the second end of the pen body; the slider is provided in the mounting groove; the coupling rod is slidably inserted into the sleeve, and the transmission shaft is slidably inserted into the bottle shoulder; or the transmission shaft is slidably inserted into the sleeve, and the coupling rod is slidably inserted into the bottle shoulder.

11. The side-pushed makeup pen according to claim 10, wherein the container assembly comprises a bottle, a piston, and a tail plug, wherein the tail plug is firmly plugged at a tail end of the bottle; the piston is hermetically provided in the bottle on an inner side of the tail plug; and an air vent communicating with an outside is formed in the tail plug.

12. The side-pushed makeup pen according to claim 1, wherein each of the first valve and the second valve is a one-way valve; an opening direction of the first valve refers to a direction from the discharge assembly to the applicator assembly; and an opening direction of the second valve refers to a direction from the container assembly to the discharge assembly.

13. The side-pushed makeup pen according to claim 12, wherein the container assembly comprises a bottle, a piston, and a tail plug, wherein the tail plug is firmly plugged at a tail end of the bottle; the piston is hermetically provided in the bottle on an inner side of the tail plug; and an air vent communicating with an outside is formed in the tail plug.

14. The side-pushed makeup pen according to claim 1, further comprising an outer cover, wherein the outer cover covers the applicator assembly; the applicator assembly comprises an application head, a nib, and an application head seat, wherein the application head is fixedly provided on the application head seat, and the application head communicates with a liquid passage in the application head seat; and the nib is fixedly sleeved outside the application head and the application head seat.

15. The side-pushed makeup pen according to claim 14, wherein the container assembly comprises a bottle, a piston, and a tail plug, wherein the tail plug is firmly plugged at a tail end of the bottle; the piston is hermetically provided in the bottle on an inner side of the tail plug; and an air vent communicating with an outside is formed in the tail plug.

16. The side-pushed makeup pen according to claim 1, wherein the container assembly comprises a bottle, a piston, and a tail plug, wherein the tail plug is firmly plugged at a tail end of the bottle; the piston is hermetically provided in the bottle on an inner side of the tail plug; and an air vent communicating with an outside is formed in the tail plug.

17. The side-pushed makeup pen according to claim 16, further comprising a replacement assembly, wherein the replacement assembly comprises an other container assembly and a replacement cover, wherein the replacement cover covers the other container assembly.

* * * * *